US008020619B1

(12) United States Patent
Robertson et al.

(10) Patent No.: US 8,020,619 B1
(45) **Date of Patent: *Sep. 20, 2011**

(54) SEVERING OF DOWNHOLE TUBING WITH ASSOCIATED CABLE

(75) Inventors: Michael C. Robertson, Arlington, TX (US); William Boelte, New Iberia, LA (US)

(73) Assignee: Robertson Intellectual Properties, LLC, Arlington, TX (US)

( * ) Notice: Subject to any disclaimer, the term of this patent is extended or adjusted under 35 U.S.C. 154(b) by 423 days.

This patent is subject to a terminal disclaimer.

(21) Appl. No.: 12/055,434

(22) Filed: Mar. 26, 2008

(51) Int. Cl.
*E21B 43/114* (2006.01)
*E21B 29/04* (2006.01)

(52) U.S. Cl. ..... 166/297; 166/376; 166/54.5; 166/55; 166/55.2

(58) Field of Classification Search ..... 166/260, 166/297, 298, 376, 54.5, 55, 55.2, 55.6, 55.7, 166/55.8
See application file for complete search history.

(56) References Cited

U.S. PATENT DOCUMENTS 4,306,622 A * 12/1981 Armstrong ..... 166/297
4,598,769 A 7/1986 Robertson
4,889,187 A 12/1989 Terrell et al.
5,320,174 A 6/1994 Terrell et al.
5,435,394 A 7/1995 Robertson
5,509,480 A 4/1996 Terrell et al.
5,584,350 A 12/1996 Schnitker et al.
5,636,692 A 6/1997 Haugen
5,709,265 A 1/1998 Haugen et al.
5,720,344 A 2/1998 Newman
5,791,417 A 8/1998 Haugen et al.
6,032,739 A 3/2000 Newman
6,186,226 B1 2/2001 Robertson
6,598,679 B2 7/2003 Robertson
6,712,143 B2 3/2004 Robertson
6,722,435 B2 4/2004 DeGeare
6,851,476 B2 2/2005 Gray et al.
6,925,937 B2 8/2005 Robertson
6,971,449 B1 * 12/2005 Robertson ..... 166/297
7,690,428 B2 * 4/2010 Robertson ..... 166/298
2005/0211429 A1 9/2005 Gray et al.

* cited by examiner

*Primary Examiner* — Daniel P Stephenson
*Assistant Examiner* — Brad Harcourt
(74) *Attorney, Agent, or Firm* — The Matthews Firm

(57) ABSTRACT

Methods for severing tubing having a cable extending along its length include lowering a first cutting torch into the tubing to a desired location, igniting the first cutting torch, and directing cutting fluids in a circumferential arc to form a first cut in the tubing and sever the cable. A second cutting torch can be lowered and positioned relative to the first cut, and ignited to direct cutting fluids radially to cut the tubing all around the circumference, enabling retrieval of the tubing. The need for precise positioning and alignment of the torches to sever both the cable and tubing is thereby eliminated.

12 Claims, 6 Drawing Sheets

SEVERING OF DOWNHOLE TUBING WITH ASSOCIATED CABLE

FIELD OF THE INVENTION

The present invention relates to methods for severing tubing in downhole wells.

BACKGROUND OF THE INVENTION

In oil and gas wells, fluids are typically produced to the surface by way of production pipe or tubing. The production tubing extends from the well head at the surface down the well to the production zone.

From time to time, it is desired to pull the production tubing from the well. For example, if the well ceases to produce economically, then downhole components, such as the production tubing, can be salvaged and used in another well.

If the production tubing cannot be pulled from the well, then it is frequently desirable to cut or sever the tubing and salvage at least part of the tubing. To cut the tubing, a torch is lowered into the tubing. A particularly effective cutting tool is my radial cutting torch, described in U.S. Pat. No. 6,598,679. The torch creates cutting fluids that project in a radial direction all around the circumference of the tool and severs the tubing with a circumferential cut. The production tubing located above the cut can then be pulled from the well.

In some wells, cables or control lines are run down the well. Some cables or lines control equipment located downhole. For example, the well may be provided with an electric submersible pump, which pump utilizes a power cable. As another example, a safety valve may be located downhole; the safety valve uses a hydraulic control line on the outside of the production tubing. The cables or lines are attached to the outside of the production tubing by clamps.

Cutting the production tubing with the exterior cable or line is difficult. Simply cutting the tubing typically leaves the cable intact, wherein the tubing portions, the upper portion and the lower portion of tubing, are tied together with the cable. Cutting the cable is difficult because the tubing effectively shields the cable from the cutting torch inside of the tubing.

In the prior art, cutting the cable is a two-step process. First, a first torch is lowered into the production tubing to make a first cut through the production tubing. This creates an opening in the tubing and exposes the cable to the inside of the tubing. Then, the first torch is removed and a second torch is lowered into the production tubing to cut the cable through the opening in the tubing. However, aligning the second torch with the tubing opening is difficult. A misalignment of the second torch results in the cable surviving intact and uncut; another torch must be lowered into the tubing for another attempt. Failing to cut the cable with the second torch increases the cost of salvaging the production tubing. Thus, it is desired to cut the cable without the need to align a torch with an opening in the pipe.

SUMMARY OF THE INVENTION

The present invention provides a method of severing tubing in a well. The tubing has a cable extending along a length of the tubing. The tubing has a circumference. A first cutting torch is lowered into the tubing. The first cutting torch is positioned at a desired location within the tubing. The first cutting torch is ignited so as to produce first cutting fluids. The first cutting fluids are directed from the first cutting torch in a partial circumferential arc in the direction of the cable, so as to make a first cut of the tubing circumference and to sever the cable with the first cutting fluids. A second cutting torch is lowered into the tubing. The second cutting torch is positioned relative to the first cut. The second cutting torch is ignited so as to produce second cutting fluids. The second cutting fluids are directed radially so as to cut the tubing all around the circumference.

In accordance with one aspect of the present invention, the step of directing the first cutting fluids in a circumferential arc further comprises directing the first cutting fluids in a circumferential arc of 180° or less.

In accordance with another aspect of the present invention, the step of positioning the second cutting torch relative to the first cut further comprises positioning the second cutting torch above the first cut.

In accordance with another aspect of the present invention, the step of positioning the second cutting torch relative to the first cut further comprises positioning the second cutting torch above the first cut a distance so as to make the tubing below the cut from the second cutting fluids fishable.

In accordance with still another aspect of the present invention, the cable is exterior of the tubing.

DESCRIPTION OF THE PREFERRED EMBODIMENT

Figure 1:
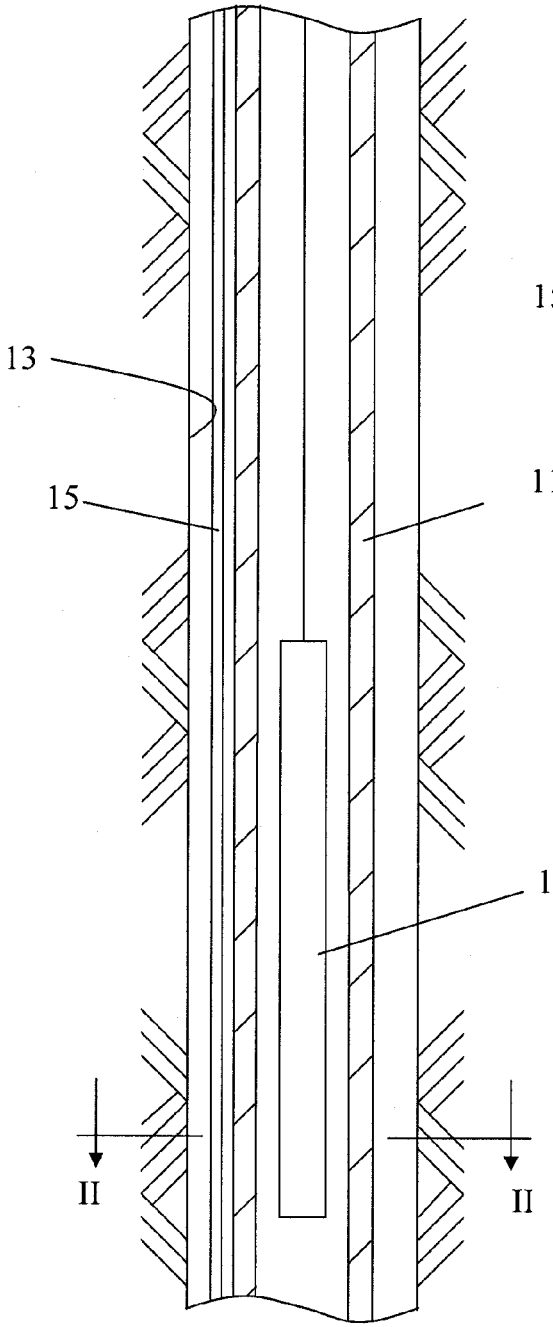
FIG. 1 is a cross-sectional view of well tubing and a cable, showing a cable cutting torch located in the tubing.

Referring to FIG. 1, the present invention cuts tubing 11 in a well 13, which tubing has an associated cable 15. The cable 15, which runs along the length of the tubing 11, inhibits complete severance of the tubing. The present invention cuts the cable and then the tubing, without the need for precise alignment of the cutting tools or torches.

Figure 3:
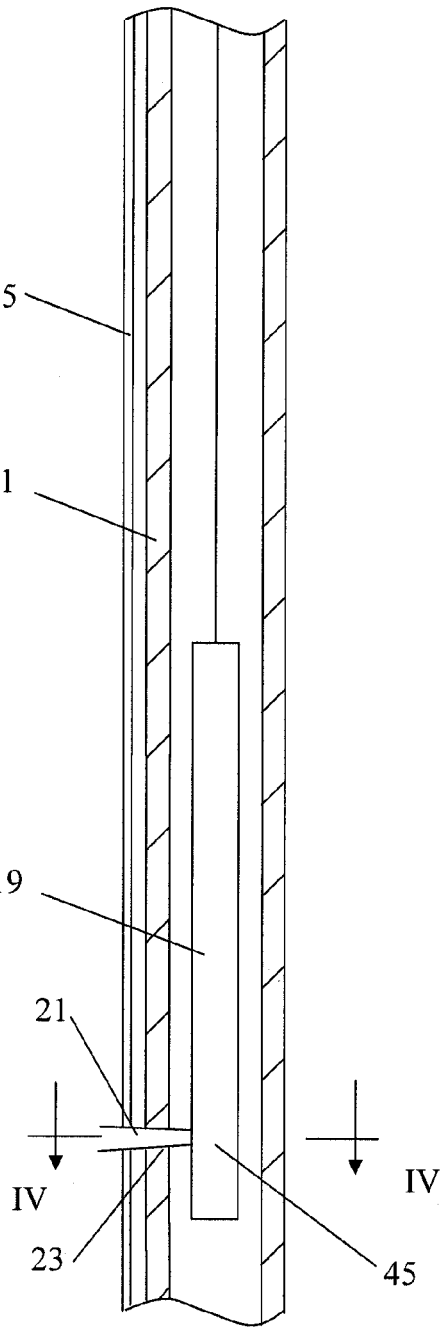
FIG. 3 is a cross-sectional view of the well tubing, with the cable cutting torch being ignited.
Figure 2:
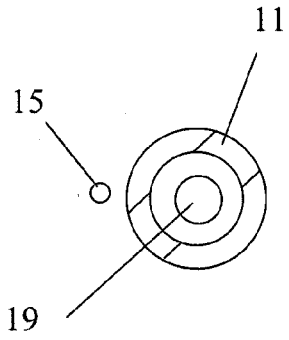
FIG. 2 is a cross-sectional view of the tubing and cable, taken at lines II-II of FIG. 1.
Figure 4:
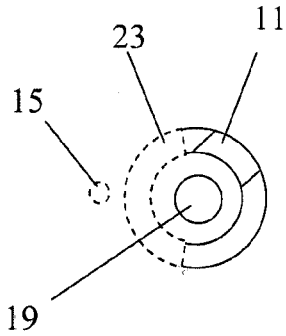
FIG. 4 is a cross-sectional view of the cable and tubing, taken along lines IV-IV of FIG. 3.

As shown in FIGS. 1 and 2, a first cutting torch 19, a cable cutting torch, is lowered into the uncut tubing 11. The cable cutting torch 19 has a nozzle for directing cutting fluids in a radial arc. The nozzle is pointed in the general direction of the cable 15. Precise alignment is not necessary. The cable cutting torch 19 is ignited, wherein the cable cutting torch generates cutting fluids 21 (see FIGS. 3 and 4) that are directed in an arc toward the cable 15. The cutting fluids 21 cut through the tubing 11, creating a first cut 23, and then through the cable 15. In FIG. 4, the cut tubing and cable are shown in dashed lines. Having cut or severed the cable, the cable cutting torch 19 is removed from the tubing.

Figure 7:
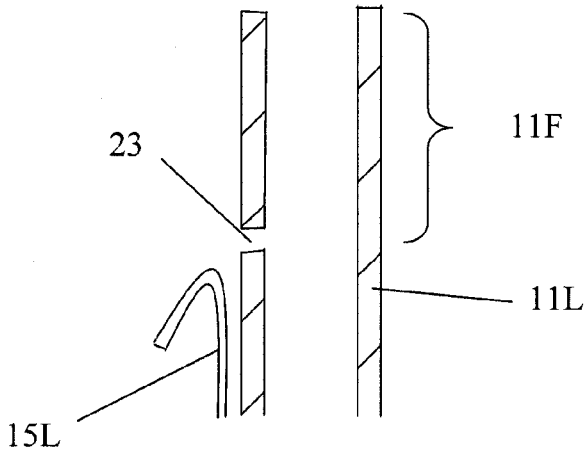
FIG. 7 is a cross-section view of the well tubing after pulling the upper portion of the tubing.
Figure 5:
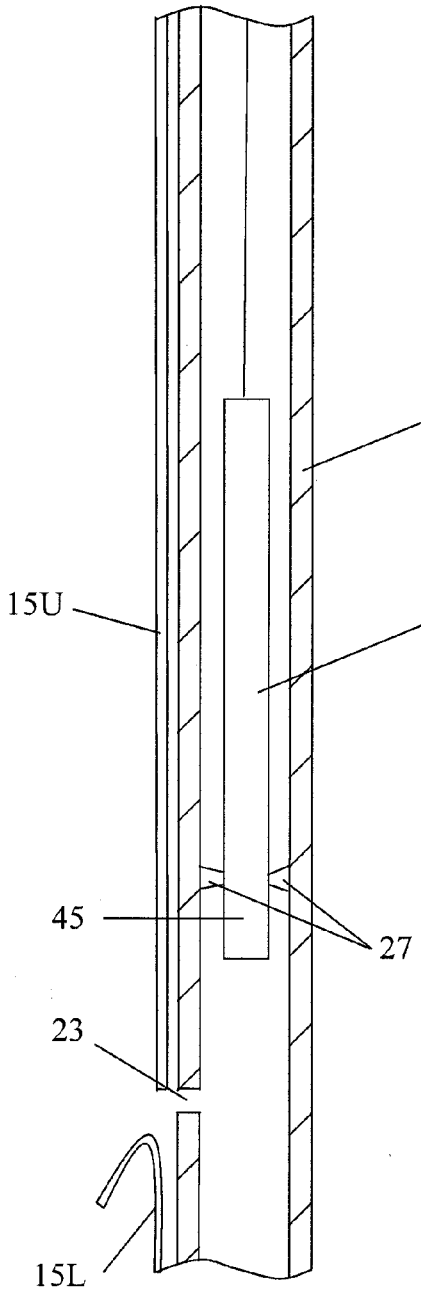
FIG. 5 is a cross-sectional view of the well tubing, shown with a tubing cutting torch.
Figure 6:
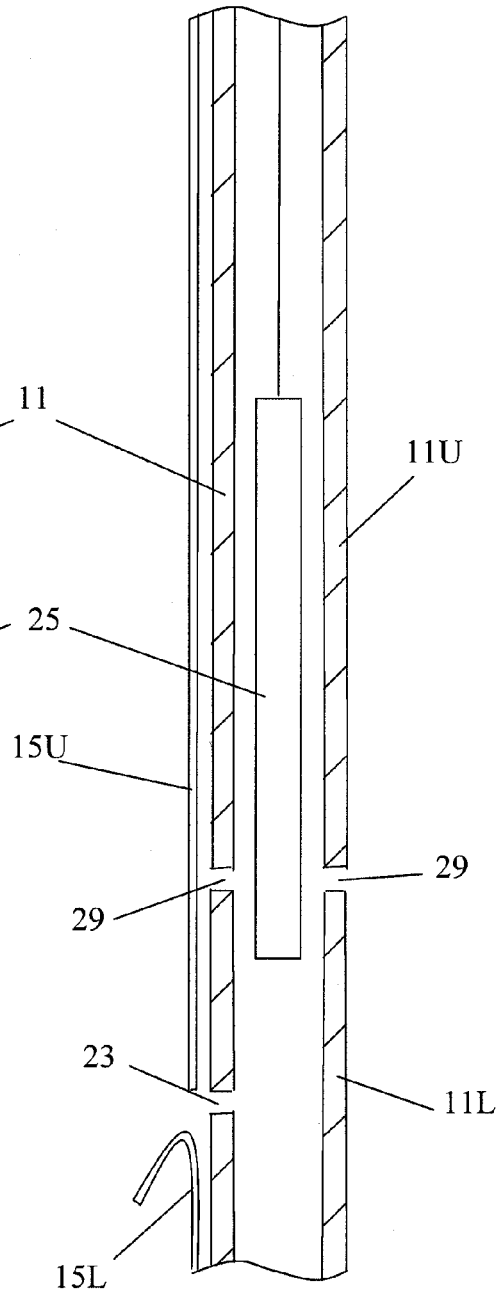
FIG. 6 is a cross-sectional view of the well tubing after severing of the tubing.

A second cutting torch 25, or tubing cutting torch, is lowered into the tubing 11 and positioned above the first cut 23 (see FIG. 5). Again, precise positioning of the tubing cutting torch 25 is not required. The tubing cutting torch 25 produces radial cutting fluids 27 in a complete circumference. Igniting the tubing cutting torch 25 creates a circumferential cut 29 in the tubing, severing the tubing into upper and lower portions 11U, 11L (see FIG. 6). The upper portion 11U of the tubing is removed. The lower portion 11L, shown in FIG. 7, presents a clean an unobstructed length at its upper end 11F which is suitable for fishing operations. The lower part 11L of the tubing can be fished in order to salvage the pipe and save the well from abandonment.

The present invention will now be discussed in more detail. The two torches 19, 25 will be described, followed by the cutting operations.

The tubing 11 can be production tubing, although it can be other types of pipe or tubing.

The cable 15 can be an electrical line, a hydraulic line, a mechanical cable, etc. The cable is typically located outside of the tubing as exterior-rigged cable is more difficult to cut than cable in the interior of the tubing. Exterior-rigged cable is effectively shielded from a cutting torch by the tubing itself. The cable 15 is attached to the tubing by a strap or by clamps (not shown) at intervals along the length of the tubing. The cable 15 is typically in contact with the tubing along the length of the tubing. Typically, the approximate location of the cable on the circumference of the tubing is known.

Figure 8:
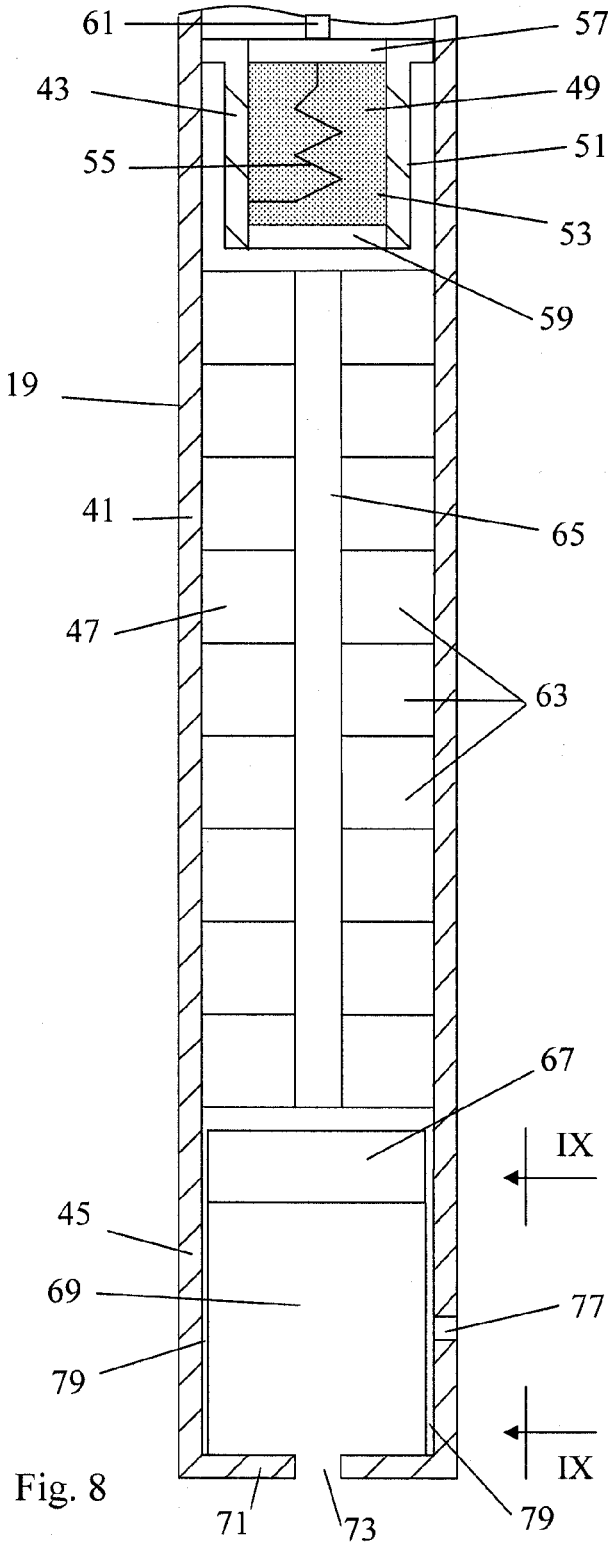
FIG. 8 is a longitudinal cross-sectional view of the cable cutting torch of FIG. 1.

The cable cutting torch 19 is shown in FIG. 8. The cable cutting torch has an elongated tubular body 41 which body has an ignition section 43, a nozzle section 45 and a fuel section 47 intermediate the ignition and fuel sections. In the preferred embodiment, the tubular body is made of three components coupled together by threads. Thus, the fuel section 47 is made from an elongated tube or body member, the ignition section 43 is made from a shorter extension member and the nozzle section 45 is made from a shorter head member.

The ignition section 43 contains an ignition source 49. In the preferred embodiment, the ignition source 49 is a thermal generator, previously described in my U.S. Pat. No. 6,925,937. The thermal generator 49 is a self-contained unit that can be inserted into the extension member. The thermal generator 49 has a body 51, flammable material 53 and a resistor 55. The ends of the tubular body 51 are closed with an upper end plug 57, and a lower end plug 59. The flammable material 53 is located in the body between the end plugs. The upper end plug 57 has an electrical plug 61 or contact that connects to an electrical cable (not shown). The upper plug 57 is electrically insulated from the body 51. The resistor 55 is connected between the contact 61 and the body 51.

The flammable material 53 is a thermite, or modified thermite, mixture. The mixture includes a powered (or finely divided) metal and a powdered metal oxide. The powdered metal includes aluminum, magnesium, etc. The metal oxide includes cupric oxide, iron oxide, etc. In the preferred embodiment, the thermite mixture is cupric oxide and aluminum. When ignited, the flammable material produces an exothermic reaction. The flammable material has a high ignition point and is thermally conductive. The ignition point of cupric oxide and aluminum is about 1200 degrees Fahrenheit. Thus, to ignite the flammable material, the temperature must be brought up to at least the ignition point and preferably higher. It is believed that the ignition point of some thermite mixtures is as low as 900 degrees Fahrenheit.

The fuel section 47 contains the fuel. In the preferred embodiment, the fuel is made up of a stack of pellets 63 which are donut or toroidal shaped. The pellets are made of a combustible pyrotechnic material. When stacked, the holes in the center of the pellets are aligned together; these holes are filled with loose combustible material 65, which may be of the same material as the pellets. When the combustible material combusts, it generates hot combustion fluids that are sufficient to cut through a pipe wall, if properly directed. The combustion fluids comprise gasses and liquids and form cutting fluids.

The pellets 65 are adjacent to and abut a piston 67 at the lower end of the fuel section 47. The piston 67 can move into the nozzle section 45.

The nozzle section 45 has a hollow interior cavity 69. An end plug 71 is located opposite of the piston 67. The end plug 71 has a passage 73 therethrough to the exterior of the tool. The side wall in the nozzle section 45 has one or more openings 77 that allow communication between the interior and exterior of the nozzle section. The nozzle section 45 has a carbon sleeve 79 liner, which protects the tubular metal body. The liner 75 is perforated at the openings 77.

The piston 67 initially is located so as to isolate the fuel 63 from the openings 77. However, under the pressure of combustion fluids generated by the ignited fuel, the piston 67 moves into the nozzle section 45 and exposes the openings 77 to the combustion fluids. This allows the hot combustion fluids to exit the torch through the openings 77.

Figure 9:
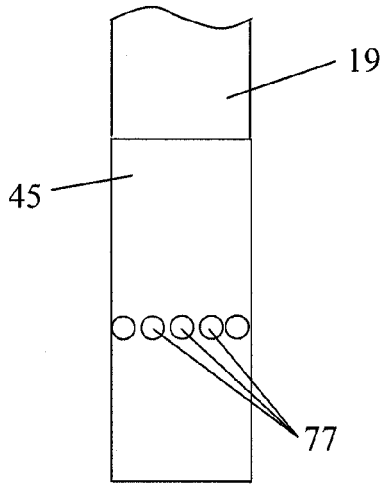
FIG. 9 is a side elevational view of the nozzle pattern of the torch of FIG. 8.

The openings 77 of the nozzle are arranged in a circumferential arc (see FIG. 9). In the preferred embodiment, this arc is 180° or less. It can be plural openings 77, as shown in FIG. 9. Alternatively, the nozzle can have a single opening in the form of a slot. The openings can be circular (as shown), rectangular or some other shape.

Figure 10:
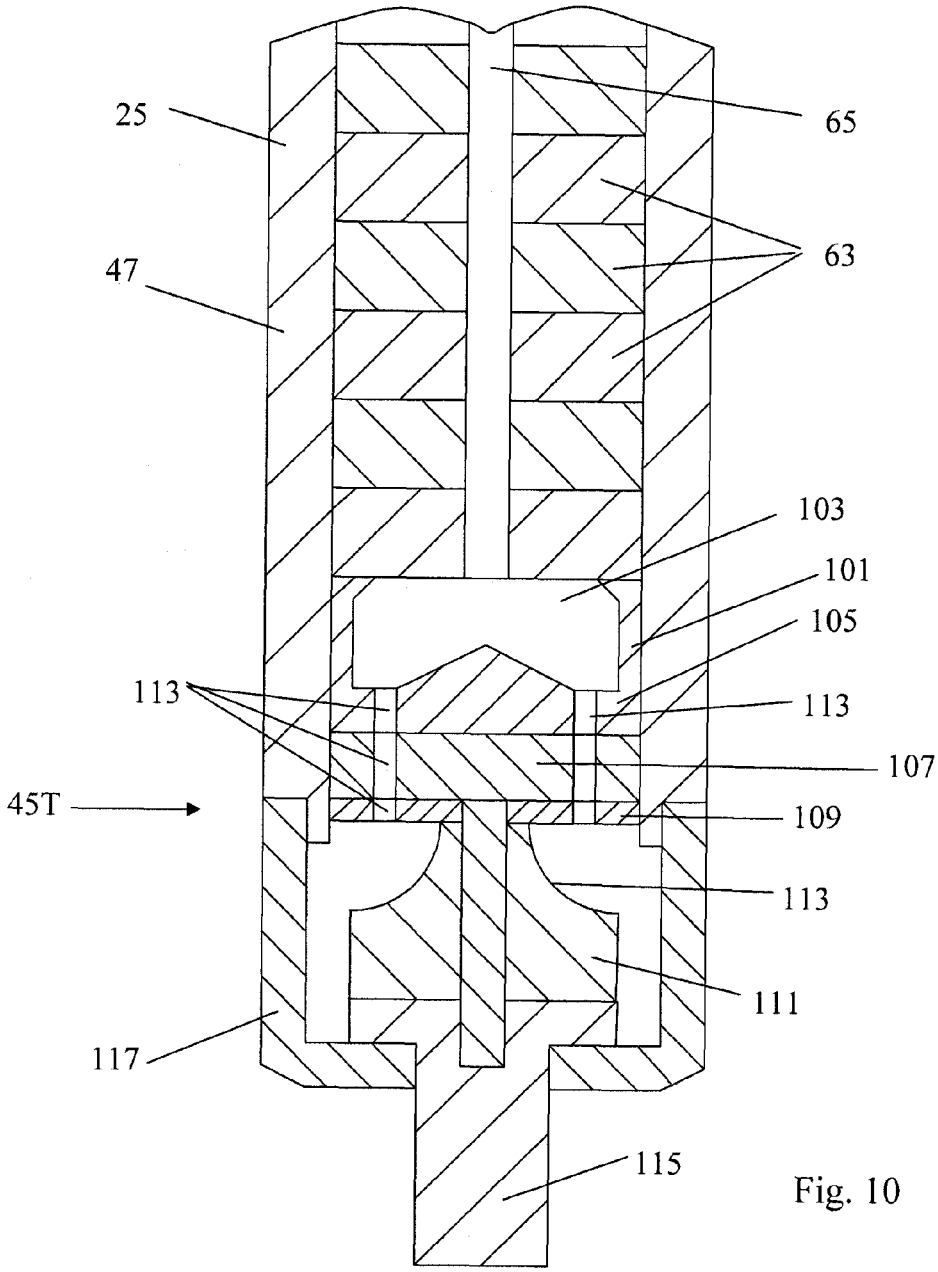
FIG. 10 is a cross-sectional view of the lower nozzle section of the tubing cutting torch, shown in a closed configuration.
Figure 11:
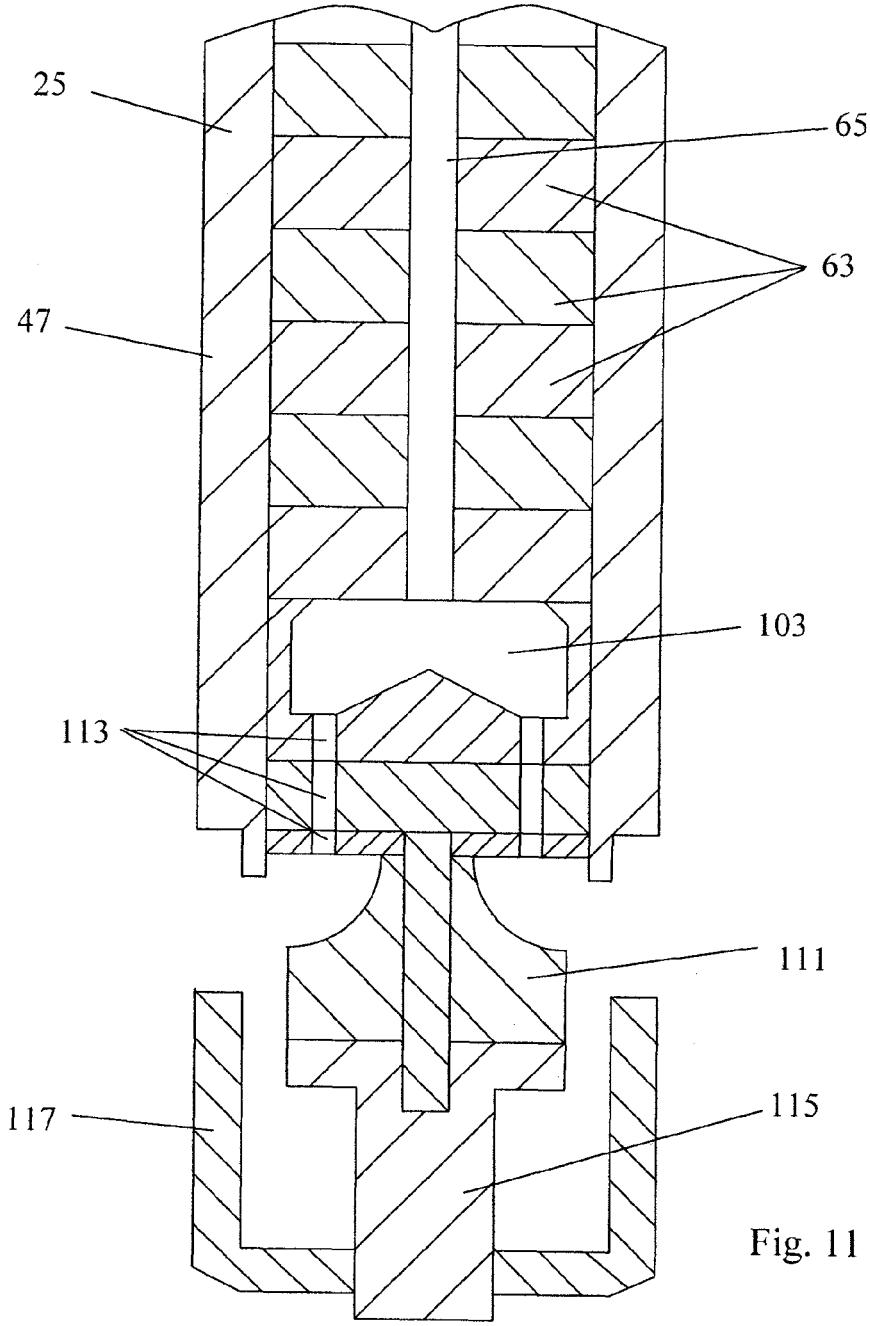
FIG. 11 is a cross-sectional view of the lower nozzle section of the tubing cutting torch, shown in an open configuration.

The tubing cutting torch 25 is radial cutting torch and is shown and described in U.S. Pat. No. 6,598,679. The tubing cutting torch 25 is similar to the cable cutting torch 19, in that it has an ignition section 43, a nozzle section 45T and a fuel section 47. Referring to FIG. 10, the nozzle section 45T of the tubing cutting torch has a support 101 for supporting the pellets 63 above a mixing cavity 103. Below the mixing cavity 103 are a carbon shield 105, a metal nozzle 107, a carbon retainer 109 and a carbon diverter 111. Apertures 113 extend through the shield 105, the nozzle 107 and the retainer 109 so that the mixing cavity 103 communicates with the space above the diverter 111. The diverter 111 has a surface 113 that flares radially out. Depending from the diverter 111 is an anchor shaft 115. A metal sleeve 117, which is cup shaped, moves along the anchor shaft 115 between open and closed positions. In the closed position (see FIG. 10), the sleeve 117 is in contact with the body of the torch and the diverter 111 is closed off from the exterior of the torch. In the open position (see FIG. 11), the sleeve 117 is moved away from the body of the torch and exposes the diverter 111. Combustion fluids push the sleeve 117 from the open position to the closed position. The diverter 111 diverts the combustion fluids radially out in a complete circumferential pattern (360°) so that the tubing is cut all around its circumference.

The tubing cutting torch 25 is conventional and commercially available.

The method will now be described. Referring to FIG. 1, the cable cutting torch 19 is lowered into the tubing 11. The torch is lowered on an electric wireline, or by some other type device. The nozzle orifices 77, or openings, are generally pointed in the direction of the cable. For example, if it is know that the cable lies in the north side of the tubing, then the nozzle orifices are pointed in the general north direction. Conventional orientation equipment can be used in conjunction with the torch 19 so that the direction of the openings 77 is known. The arc of the nozzle openings 77 will typically spread 180° or less, which would be approximately from west to north to east. Thus, the pointing of the cable cutting torch 19 need not be precise as the arc of cutting fluids will intersect the cable. If the tubing 11 is thick walled, then it may be possible to maintain a wide arc of about 180° by using more fuel. An extension adapter can be used to provide more fuel for the torch. Alternatively, if the location of the cable is known more precisely, then the cable cutting torch can be pointed more precisely and the arc can be narrower.

The cable cutting torch 19 is located some distance above the stuck point of the tubing 11.

The cable cutting torch 19 is ignited. If the torch is on an electric wireline, an electric signal is sent to ignite the torch. Other ways of igniting the torch include a battery with a trigger mechanism used in a slick line, pressure fired, or using a battery powered drive bar.

When the cable cutting torch 19 is ignited (see FIGS. 3 and 4), combustion fluids 21, or cutting fluids, exit the openings 77 in an arc and cut through the tubing 11 and then sever the cable 15. The circumferential portion of the tubing that is cut is referred to as the first cut 23. The circumferential portion of the tubing that is in back of the torch and not exposed to the openings 77, is not cut. Therefore, the first cut 23 extends partially around the circumference of the tubing. Thus, the cable cutting torch can direct all of the cutting energy through the tubing and onto the cable 15. The cable 15 is cut in a single cutting operation. If the combustion fluids 21 happen to intersect a strap or clamp for securing the cable to the tubing, the strap or clamp is also cut.

After the cable 15 is cut, the cable cutting torch 19 is removed from the tubing 11. Then, the tubing cutting torch 25 is lowered into the tubing 11 and positioned above the first cut 23, as shown in FIG. 5. If it is desired to attempt to fish or retrieve the lower portion of the tubing 11L, then the tubing cutting torch 25 should be located a sufficient distance above the first cut 23 so as to allow the use of fishing or retrieval tools. The tubing cutting torch 25 need not be precisely positioned relative to the first cut 23.

Once positioned, the tubing cutting torch 25 is ignited. Combustion fluids 27 exit radially from the torch 25 and cut the tubing wall 11 all around the circumference (see FIG. 6). This is a second cut 29. The tubing is now severed into an upper portion 11U and a lower portion 11L. The tubing cutting torch 25 is then removed from the tubing. The upper portion 11U of the tubing, which is above the second cut 29, is removed. Removal of the tubing also removes the upper part 15U of the cut cable. As shown in FIG. 7, the lower part of the tubing 11L, along with the lower part of the cable 15L, remains in the well. The upper end 11F of the lower part of the tubing is clean and unobstructed. Fishing tools can be used in an attempt to retrieve the lower part of the tubing by way of the upper end 11F.

Each of the torches can be provided with ancillary equipment such as an isolation sub and a pressure balance anchor. The isolation sub typically is located on the upper end of the torch and protects tools located above the torch from the cutting fluids. Certain well conditions can cause the cutting fluids, which can be molten plasma, to move upward in the tubing and damage subs, sinker bars, collar locators and other tools attached to the torch. The isolation sub serves as a check valve to prevent the cutting fluids from entering the tool string above the torch.

The pressure balance anchor is typically located below the torch and serves to stabilize the torch during cutting operations. The torch has a tendency to move uphole due to the forces of the cutting fluids. The pressure balance anchor prevents such uphole movement and centralizes the torch within the tubing. The pressure balance anchor has either mechanical bow spring type centralizers or rubber finger type centralizers.

Thus, the present invention provides the severing of tubing and associated cable in a reliable manner. Two cutting torches are used, one to cut the cable and the other to cut the tubing. Because one torch is used to cut through the tubing and the cable, there is no need to align a torch with an opening, as in the prior art. The second torch, which cuts the tubing, need only be located relative to the cut cable.

It may be that, after making the first and second cuts 23, 29, the lower end of the upper part 15U of the cable is attached to the upper end of the lower portion 11L of the tubing by one or more straps, clamps or other type of cable anchors. This is dependent on the spacing of the cable anchors and the distance of the second cut above the first cut. These cable anchors will yield or break when the upper portion 15U of tubing is pulled from the well.

Although in the description of the preferred embodiment, the second torch 25 is described as being located above the first cut 23, this need not be so. The second torch could be located below the cut cable, so that the second cut is below the first cut. If the upper portion of the cable 15U is attached to the lower portion 11L of tubing by one or two anchors, then the anchors are broken and the upper part of the cable 15U is freed from the lower portion 11L of tubing by pulling the upper portion 11U of tubing.

Although in the preferred embodiment the cable cutting torch is used before the tubing cutting torch, this need not be so. The tubing cutting torch can be used before the cable cutting torch. Once the tubing is severed, the upper portion 11U may become misaligned from the lower portion 11L so that the longitudinal axes are no longer co-axial. However, in some wells, the tubing may be stabilized in the well so that misalignment may not pose a problem. Alternatively, after severing the tubing, the cable cutting torch can be lowered until it comes close to or contacts the lower portion 11L of tubing, wherein the cable cutting torch is ignited near the bottom of the upper portion 11U of tubing.

The foregoing disclosure and showings made in the drawings are merely illustrative of the principles of this invention and are not to be interpreted in a limiting sense.

The invention claimed is:

1. A method of severing tubing in a well, the tubing having a cable extending along a length of the tubing, the tubing having a circumference, comprising the steps of:

a) lowering a first cutting torch into the tubing;

b) positioning the first cutting torch at a desired location within the tubing;

c) igniting the first cutting torch so as to produce first cutting fluids;

d) directing the first cutting fluids from the first cutting torch in a circumferential arc in a direction of the cable, so as to make a first cut of a portion of the tubing circumference and sever the cable with the first cutting fluids from the first torch;

e) lowering a second cutting torch into the tubing;

f) positioning the second cutting torch relative to the first cut;

g) igniting the second cutting torch so as to produce second cutting fluids; and h) directing the second cutting fluids radially so as to cut the tubing all around the circumference.

2. The method of claim 1, wherein the step of directing the first cutting fluids in a circumferential arc further comprises the step of directing the first cutting fluids in a circumferential arc of 180° or less.

3. The method of claim 1, wherein the step of positioning the second cutting torch relative to the first cut, further comprises the step of positioning the second cutting torch above the first cut.

4. The method of claim 3, wherein the step of positioning the second cutting torch relative to the first cut further comprises the step of positioning the second cutting torch above the first cut a distance so as to make the tubing below the cut from the second cutting fluids fishable.

5. The method of claim 1, wherein the cable is exterior of the tubing.

6. A method for severing a tubular string having a cable extending along a length thereof, comprising the steps of:

a) lowering a first cutting apparatus into the tubing;

b) actuating the first cutting apparatus to form a first cut in the tubing and sever the cable;

c) lowering a second cutting apparatus into the tubing; and d) actuating the second cutting apparatus to form a second cut in the tubing.

7. The method of claim 6, wherein the first cutting apparatus comprises a cutting torch having apertures therein for directing cutting fluids, and wherein the step of actuating the first cutting apparatus to form the first cut comprises directing cutting fluids through the apertures.

8. The method of claim 7, wherein the apertures are positioned to direct the cutting fluids in a circumferential arc of 180° or less, and wherein the step of actuating the first cutting apparatus to form the first cut comprises cutting the tubing partially along a circumference thereof.

9. The method of claim 6, wherein the step of actuating the first cutting apparatus to form the first cut comprises cutting the tubing partially along a circumference thereof.

10. The method of claim 9, wherein cutting the tubing partially along a circumference thereof comprises forming the first cut along a circumferential arc of 180° or less.

11. The method of claim 6, wherein the second cutting apparatus comprises a radial cutting torch, and wherein the step of actuating the second cutting apparatus to form the second cut comprises directing cutting fluids to form a circumferential cut along a portion of a circumference of the tubing sufficient to enable removal of at least a portion of the tubing.

12. The method of claim 6, wherein the step of actuating the second cutting apparatus to form the second cut comprises forming the second cut a distance above the first cut to enable fishing of a lower portion of the tubing.

* * * * *